United States Patent [19]

Brennan

[11] Patent Number: 5,050,733

[45] Date of Patent: Sep. 24, 1991

[54] SOCKET WRENCH ORGANIZER ASSEMBLY

[76] Inventor: Thomas P. Brennan, One Burr Ave., Morganville, N.J. 07751

[21] Appl. No.: 566,100

[22] Filed: Aug. 13, 1990

[51] Int. Cl.[5] ..... B65D 85/00

[52] U.S. Cl. ..... 206/373; 206/376; 206/493; 206/561

[58] Field of Search ..... 206/372, 373, 376, 377, 206/378, 493, 561

[56] References Cited

U.S. PATENT DOCUMENTS

| | | | |
|---|---|---|---|
| 1,654,703 | 1/1928 | Rice | 206/378 X |
| 1,712,473 | 5/1929 | McWethy | 206/378 |
| 2,509,507 | 5/1950 | Kane | 206/377 |
| 3,726,393 | 4/1973 | Thompson | 206/378 |
| 4,337,860 | 7/1982 | Carrigan | 206/378 X |
| 4,380,293 | 4/1983 | Wilcox et al. | 206/378 X |
| 4,865,194 | 9/1989 | Decarie | 206/378 |
| 4,884,689 | 12/1989 | Chin | 206/561 X |

*Primary Examiner*—Paul T. Sewell
*Assistant Examiner*—Jacob K. Ackun, Jr.
*Attorney, Agent, or Firm*—Cushman, Darby & Cushman

[57] ABSTRACT

A tray for organizing the components of a multi-component tool set is provided which includes a number of rectilinear storage compartments for components of particular sizes and types. The rectilinear compartments may include dowel elements for receiving components and retaining the same in a particular disposition. The rectilinear compartments may also include width reducing inserts so as to facilitate storage of components in order of descending size. Dowel element inserts may be removably or permanently disposed in rectilinear compartments of the organizer so that the organizer can be adapted to store tool sets having a particularly large number of a particular component type or size. Likewise, such inserts can be provided so that the organizer can be customized to a particular tool set.

13 Claims, 4 Drawing Sheets

SOCKET WRENCH ORGANIZER ASSEMBLY

BACKGROUND OF THE INVENTION

The invention relates to assembly kits and components for the functional organization, storage and use of tools, in particular, to a multi-compartment tray for socket wrenches.

A problem common to mechanics, repairmen and individuals alike is the storage of components of tool sets, such as socket wrenches, particularly due to the varied sizes, lengths and types. For those who use such multi-component sets it would be desirable to provide a kit or assembly wherein the tools can be organized in a functional manner addressing the unique storage requirements of the various types.

While a variety of tool organizers have been proposed, typically such organizers store components on a common base level or deep sockets wrenches horizontally. These configurations are disadvantageous as it is difficult to retrieve smaller sockets from larger stored sockets, as well as to determine the exact size or type of any horizontally disposed units.

It would therefore be desirable to provide a multi-compartment organizer which allows easy storage and retrieval of socket wrenches of various lengths in order that standard socket and deep sockets can be stored together by size and type on a functional vertical use level.

It would further be desirable to include compartments for related tools or components which are readily accessible to the user.

SUMMARY OF THE INVENTION

The socket wrench organizer of the invention overcomes storage problems by enabling all different types and sizes of sockets to be stored in a single organizer tray in a manner such that their type and dimensions can be readily ascertained. The organizer of the invention preferably also includes one or more compartments for related tools and components. Thus the tray of the invention includes at least one socket wrench organizer compartment and one or more compartments for accommodating particular socket types or associated tools. The organizer assembly of the invention can be placed in a tool cabinet or may be positioned in the drawer of such a cabinet. In the alternative, the tray can be placed in a workshop drawer or on a shelf of a table, depending upon the access and portability required by the user.

The multi-compartment socket wrench organizer can be formed so that each of the compartments is integrally molded to a common base so as to provide a predetermined and fixed configuration. In the alternative, rectilinear compartments can be selectively disposed on a common base and secured thereto to provide an assembled multi-compartment socket wrench organizer. The resulting socket wrench organizer may include one or more removable and replaceable compartments so that varying requirements of the user can be accommodated.

Even further and most preferably, one or more of the compartments of the multi-compartment container has a width which varies along the length thereof to facilitate the storage of sockets of varying diameter, in order of decreasing size. Such elongated socket receiving compartments may also include dowel elements therewithin for facilitating placement of sockets in predetermined spaced location. The versatility required for various storage compartments would dictate whether such dowel elements would be desirable and the particular spacing and size thereof. The various compartments of the multi-compartment organizer can also have varying depths so that sockets of various heights are equally accessible to the user. Such depth variation also facilitates location of a proper compartment for storing a particular socket.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
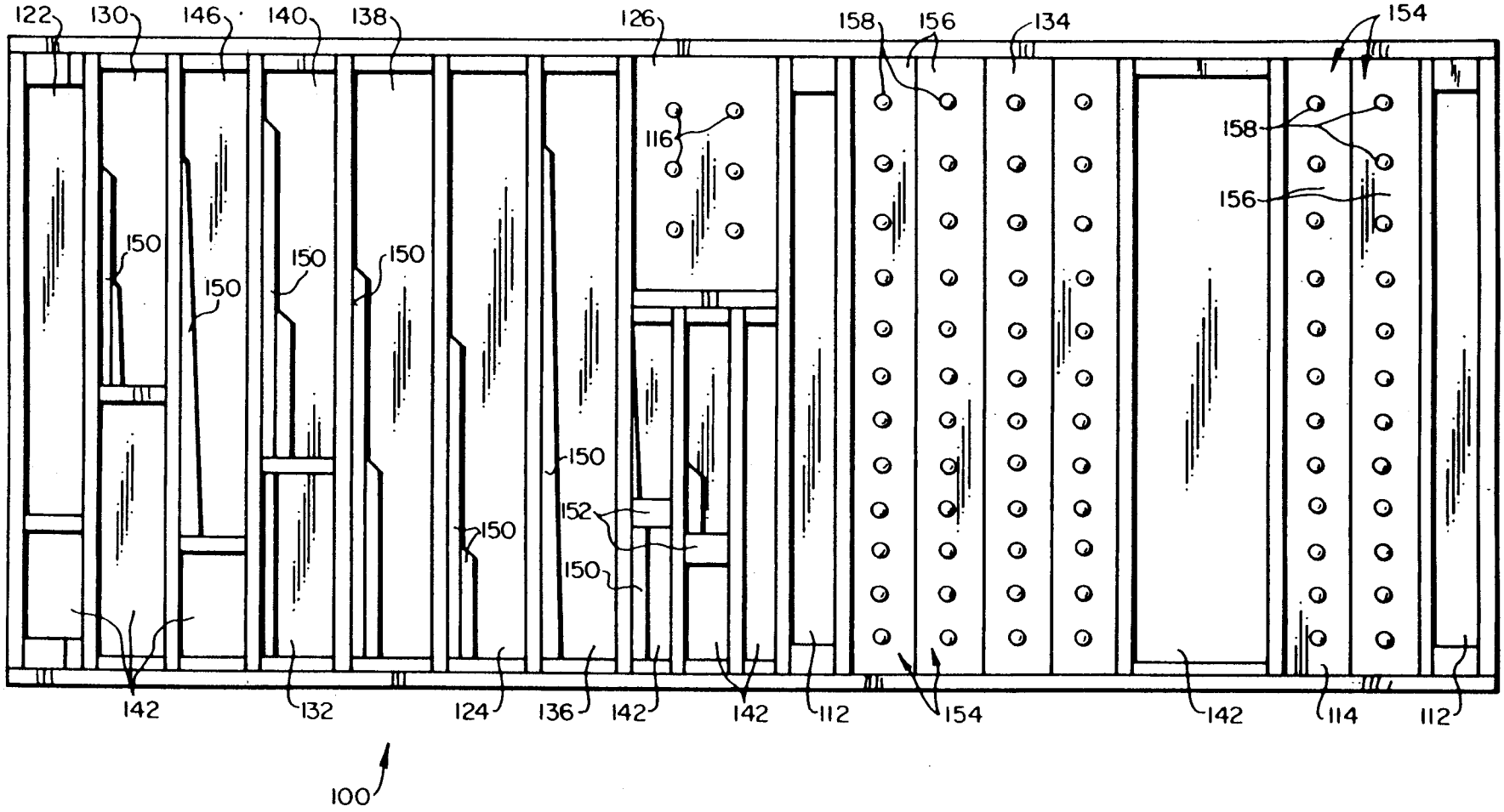
FIG. 1 is a top plan view of a socket wrench organizer in accordance with the present invention.
Figure 2:
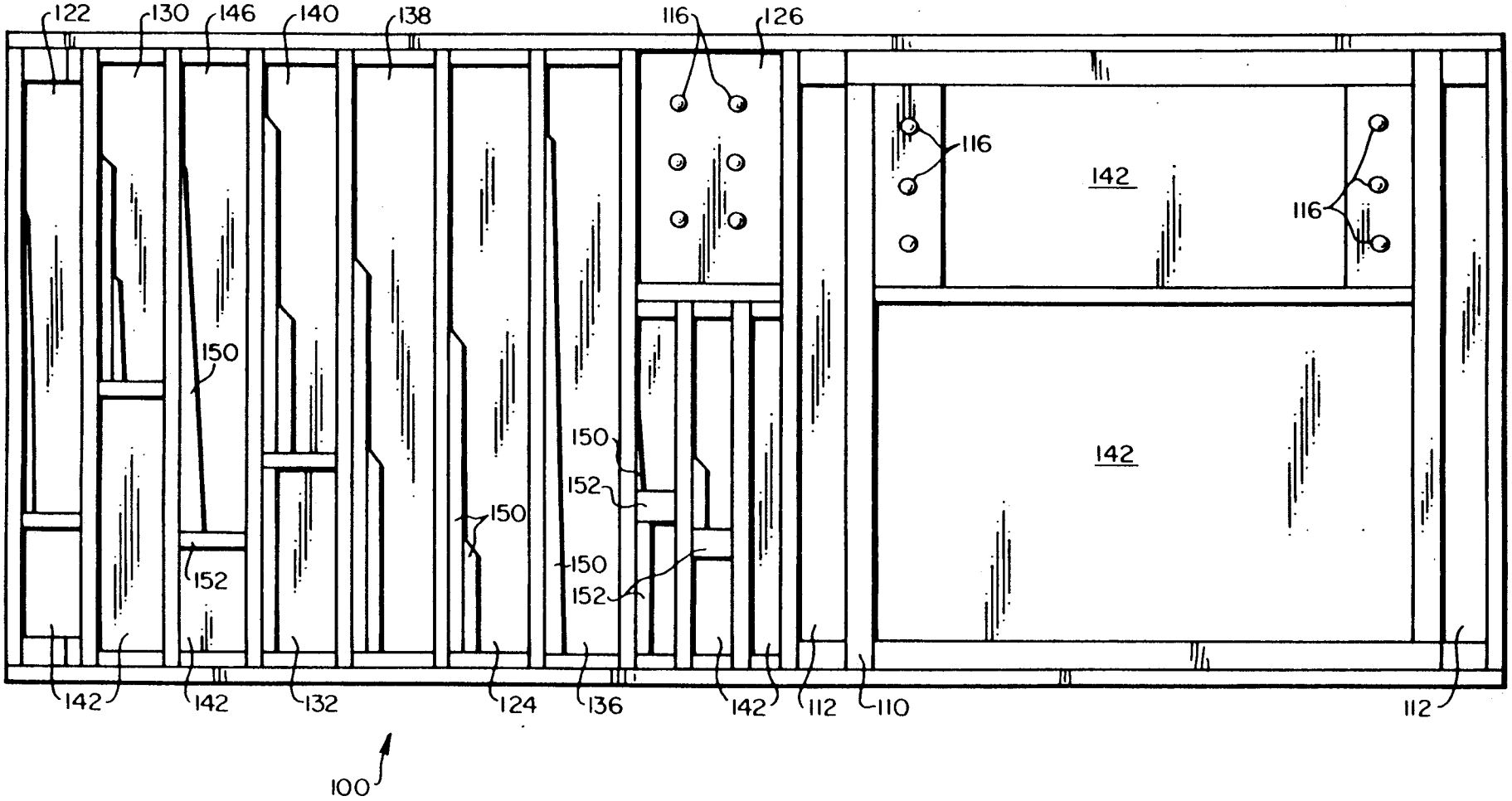
FIG. 2 is a top plan view of a socket wrench organizer, similar to FIG. 1, but with a removable insert for accommodating associated tools.
Figure 3:
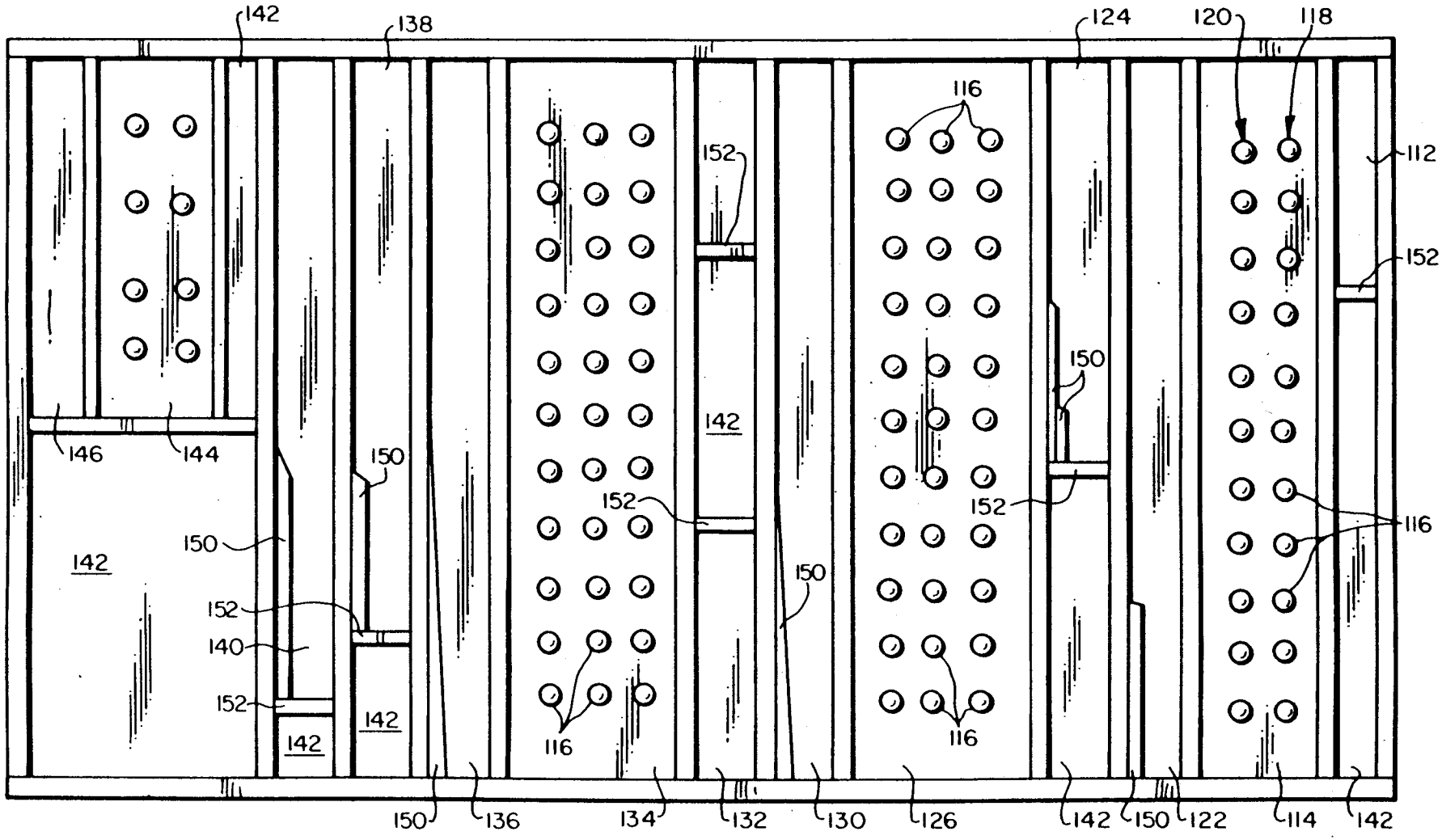
FIG. 3 is a top plan view of a further alternate socket organizer in accordance with the invention.

As shown in FIGS. 1–3, the invention relates to an organizational tray 100 for storing various sizes and types of sockets, both metric and standard. The socket organizer assembly is divided into four major storage sections so that larger sockets and impact socket sizes can be accommodated in one area, spark plug sockets in another area, smaller socket sizes in yet a further area and, finally, a removable work tray insert 110 can be provided (FIG. 2). Such a work tray can have dowel elements 116, open spaces 142 and/or elongate channels as desired. The dowel elements can be provided by inserts 154 (FIG. 4) of reduced length.

Each unit or tray can be produced for individual use or stacked based upon the dimensions of the storage area. Thus, different organizational assemblies can be provided to accommodate various tool sets and stacked one on top of the other so that a particular tool set can be accessed and employed at a particular time.

The multi-compartment socket wrench organizer of the invention saves time by facilitating the location of a proper type and size socket or sockets for a required job. Furthermore, with the structure of the invention, it is easy to identify any lost or missing components.

As will become more apparent below, the particular number, size and location of elongated compartments, compartments having dowel elements and compartments of varying width can be varied without departing from the concept of the invention, as defined in the claims. For illustrative purposes, three configurations have been illustrated with like compartments and elements. One of those configurations is described in detail.

Thus, by way of example, the multi-compartment organizer illustrated in FIG. 3 includes an elongated compartment 112 for storage of ¼ inch deep sockets and an elongated rectilinear compartment 114 having a plurality of up standing dowel elements 116. The dowel elements can be provided by storage inserts 154 having dowel elements 158 of the type shown in FIG. 4 which are secured in a rectilinear cavity. Otherwise dowels can be secured to the tray base for the storage of ¼ inch standard sockets. In the FIG. 3 embodiment, one row 118 of dowels 116 may be use to carry 6 point ¼ inch standard sockets and on the other row 120 for 12 point. Yet a further elongated storage compartment 122 is provided for storage of ⅜ inch, 6 point deep sockets. Further, such deep sockets can also be stored in elongated compartment 124.

Rectilinear compartment 126 is for the storage of ⅜ inch 6 point standard sockets. Again, a plurality of dowel elements 116 are provided for individually receiving a particular socket and restricting the same from horizontal movement from a desired disposition. Yet another elongated storage compartment 130 is provided for, for example, ⅜ inch 12 point deep sockets which may also be provided in compartment 132. A further dowel support storage section 134 is provided for ⅜ inch 12 point standard sockets. Storage for ½ inch, 6 point standard sockets is also provided by an elongated compartment 136.

Storage of ½ inch 12 point standard sockets is made possible by yet a further elongated compartment 138. Impact sockets which are ½ inch and 6 point can be stored in elongated compartment 140. One or more further areas 142, can be provided for open storage, that is they can be used for duplicate sockets or for tools associated with the socket wrench set. The open storage sections 142 are open areas for expansion or for any desired purpose. Thus, for example, if a particular tool set includes more spark plug sockets or, for example 6 point standard sockets, than the dowel pins provided in a particular storage section, a no pin storage section 142 or a portion of the length of an elongated cavity can be provided with a socket support insert 154, of the type shown in FIG. 4 for supporting such additional sockets.

Yet a further storage compartment 144 having dowels 116 is provided for the storage of spark plug sockets and, finally, an elongated storage compartment 146 is provided for ½ inch deep sockets.

The concept of the wrench organizer of the invention is to store socket wrenches of varying types and sizes in a functional use oriented arrangement. The concept of the rectangle is critical to the invention which enables the combination of various storage sections having varying length and width into a single unit. Indeed, each section can be produced independently and fastened to a storage base by metal fasteners, tape or any bonding material. Thus, various compartments for accommodating various types of sockets having various widths, lengths and numbers can be provided and independently assembled to provide an organizer in accordance with the invention.

Certain of the elongated cavities of the organizer of the invention are reduced in width along at least a portion of the length thereof. More particularly, one or more rectilinear compartments can further be provided with intra-linear reduction means 150 so as to vary the width thereof to accommodate sockets of a particular type and height which vary in width. The concept of intra-linear reduction uses the restricted value of the side walls of the rectangle to the maximum extent possible. Thus, such intra-linear reducers of various types are used to restrict movement of a particular type of socket within a storage cavity or to create two smaller rectilinear storage compartments from a single elongated rectilinear cavity with a transverse element or partition member 152.

In addition to the width restrictions within a particular compartment, bottoms of varying depth can be provided in various compartments so that vertical storage of large or deep sockets as well as relatively small or short sockets can be provided while permitting easy access to all types of sockets.

Preferably, the intra-linear reduction means 150 are provided as separate units which are inserted into a particular organizer. This is because various wrench sets may have varying width sockets as well as varying numbers of sockets of a particular width. The provision of an initially separate, tapered or rectilinear insert 150 makes possible the storage of more than one socket of the same size and type in a particular elongated cavity. Thus, the provision of tapered inserts maximizes the versatility of the organizer of the invention.

Further, to accommodate additional types of sockets or additional numbers of particular sockets, as noted above, a given elongated channel can be reduced in length for one socket type by providing a partition member 152 and the additional sockets of another type can be placed in the newly defined additional elongated cavity. An intra-linear reduction member 150 and/or dowel elements 116 can be provided in such additional elongated cavities as was also discussed briefly above.

Figure 4:
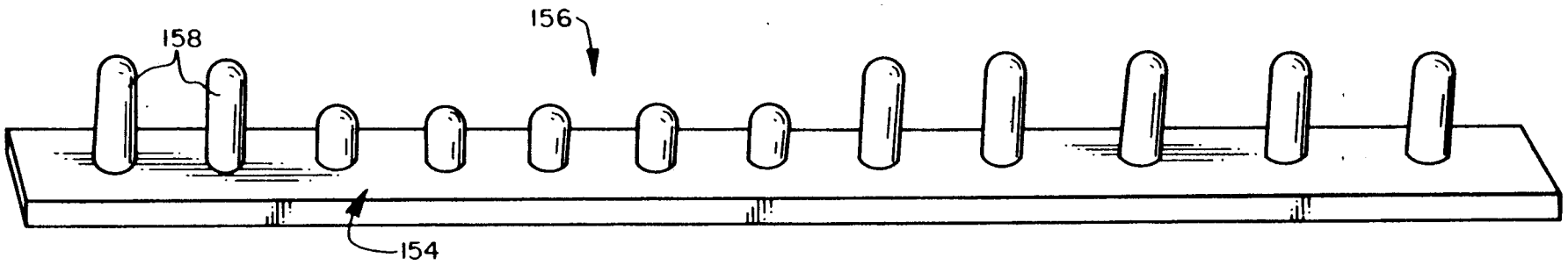
FIG. 4 is a perspective view of a socket organizer insert in accordance with the invention.

As shown, for example, in FIG. 4, socket organizer inserts 154 can be formed from a base element 156 and a plurality of dowel elements 158 of varying heights and/or variable spacings from one another. The height and spacing of dowels 158 along the insert base 156 can, of course, be selected to accommodate a particular type and number of sockets. Likewise, the dimensions of the dowels 158 as well as the thickness of the base 156 can be determined depending upon the sockets which are to be stored thereon. A particular organizer insert can thus be inserted into a particular elongated channel so as to facilitate storage of sockets therewithin. Likewise, the dowel elements in the spark plug socket compartment as well as the 6 point standard socket compartment can be defined by a plurality of linear dowel carrying inserts 154 of the type shown in FIG. 4, spaced in parallel side-by-side relation and secured to the organizer base by fasteners, adhesive or the like. In the alternative, such inserts can simply be placed into the organizer so that removal thereof is easy.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims. Thus, for example, the organizer of the invention can be completely or partially pre-assembled or can be provided as a kit which can be assembled in a configuration particularly suited to a particular tool set or users needs. Further, the various components can be removably or fixedly coupled together. Even further, the dowel elements, base, partitions and linear reduction elements can be formed from any suitable material such as, for example, wood, metal, or plastic.

What is claimed is:

1. A multi-compartment socket wrench organizer assembly comprising:

a support base having first and second sidewalls and first and second endwalls, at least one vertical wall extending between said first and second sidewalls so as to define at least first and second compartments on said support base, at least one of said compartments including a plurality of vertically extending dowel elements for receiving and retaining a socket element in a predetermined position on said support base, at least one of said compartments being an elongated substantially rectilinear compartment, means within said elongated substantially rectilinear compartment extending along at least a portion of the length thereof for progressively varying a width of a storage space defined within said elongated substantially rectilinear compartment so that said storage space has a maximum width adjacent a first longitudinal end of said portion and a minimum width adjacent a second longitudinal end thereof.

2. An organizer as in claim 1, wherein said dowel elements are disposed in a row.

3. An organizer as in claim 2, wherein a plurality of rows of dowel elements are defined within said at least one compartment.

4. An organizer as in claim 1 including at least one transverse wall member for dividing a said elongated substantially rectilinear compartment into first and second subcompartments, each said subcompartment defining a storage space, at least one of said subcompartments including a said means for progressively varying a width of said storage space thereof, each said first and second subcompartment extending across a portion of the width of said support base.

5. An organizer as in claim 1, wherein at least two of the compartments of said support base have different depths.

6. An organizer as in claim 1, wherein at least two of said dowel elements have different heights.

7. An organizer as in claim 1, wherein said dowel elements are non-uniformly spaced from one another.

8. An organizer as in claim 2, wherein said dowel elements are non-uniformly spaced from one another.

9. An organizer as in claim 1, further including a work tray insert removably disposed on said support base.

10. An organizer as in claim 1, wherein at least some of said dowel elements are secured to a dowel insert base member, said dowel insert base member being disposed on said support base.

11. An organizer as in claim 10, wherein said dowel insert base member is rigidly coupled to said support base.

12. A organizer as in claim 1, wherein said means for progressively varying the width includes means defining a substantially continuously inclined surface so as to continuously and progressively vary a width of the storage compartment from a maximum diameter to a minimum diameter along said portion of the length of said compartment.

13. An organizer as in claim 1, wherein said means for progressively varying comprises means for varying the width in discreet increments progressively from the maximum to the minimum width.

* * * * *